United States Patent [19]

Johansson

[11] 4,279,191

[45] Jul. 21, 1981

[54] FIREARMS

[75] Inventor: Carl B. Johansson, Arlöv, Sweden

[73] Assignee: Aimpoint AB, Malmo, Sweden

[21] Appl. No.: 84,276

[22] Filed: Oct. 12, 1979

[30] Foreign Application Priority Data

Apr. 11, 1979 [SE] Sweden ..... 7903210

[51] Int. Cl.[3] ..... F41D 3/06

[52] U.S. Cl. ..... 89/185; 89/191 A; 89/196

[58] Field of Search ..... 89/172, 185, 191 A, 89/196

[56] References Cited

U.S. PATENT DOCUMENTS

| | | | |
|---|---|---|---|
| Re. 26,872 | 4/1970 | Dieckmann | 89/196 |
| 3,424,053 | 1/1969 | Close | 89/185 |
| 4,095,507 | 6/1978 | Close | 89/185 |

*Primary Examiner*—Stephen C. Bentley

[57] ABSTRACT

An arrangement in firearms having a barrel and a bolt. The bolt is provided with means mounting the bolt for axial displacement and rotation on the outside of the barrel. A carrier displaceably mounted on the outside of the barrel is operatively connected to the bolt to axially displace the bolt to and from a firing position and to rotate the bolt in said position to engage and disengage the bolt at locking means on the outside of the barrel by axial displacement of the carrier.

10 Claims, 12 Drawing Figures

FIREARMS

The invention relates to firearms, particularly automatic carbines, riffles and pistols and similar lightweight automatic firearms, comprising a barrel, at least one locking element on the barrel, a bolt at one end of the barrel, which is axially displaceable to and from a firing position and is rotatable to engage and disengage said locking element for locking the bolt in the firing position, spring means biasing the bolt towards the firing position, an axially displaceable element for displacing the bolt against the spring bias away from the firing position, and guide means for rotating the bolt after axial displacement thereof to the firing position to engage the locking element and before axial displacement of the bolt from the firing position to disengage the locking element.

Firearms of this type are previously known and one prior art embodiment thereof is disclosed in the Swedish Pat. No. 123,901. The piston of a piston-cylinder device communicating with the bore of the barrel through a gas port in that case forms said axially displaceable element, the piston being slidably mounted on the barrel in a cylinder attached to the barrel and surrounding the piston and the barrel. The piston is biased by means of a pressure spring, and can be displaced against the spring bias by gas pressure generated in the bore at firing, which is communicated to the cylinder through the gas port. The piston is operatively connected to the bolt to rotate the bolt. At displacement of the piston by gas pressure the bolt is rotated initially to disengage locking projections inside the barrel, by which the bolt is held in firing position, and is then carried along by the piston against the spring bias whereupon the pressure spring when the gas pressure has been relieved returns the piston and the bolt. At the end of this return movement the bolt is again rotated but now in the opposite direction such that the bolt engages again the locking projections to be locked in the firing position thereof. Thus, there is in this case a positive connection between the piston and the bolt and, therefore, the stroke of the piston must be as large as is necessary to provide the disengagement and engagement movement and to impart to the bolt the axial movement required for ejecting the empty cartridge case and introducing a new cartridge into the chamber.

German Pat. No. 736,746 describes an arrangement in firearms of the kind referred to above wherein a socket in a manner not shown or described in more detail is connected to a piston which can be displaced by gas pressure, said socket being guided for axial displacement on a rearwardly extended part of the bolt. The bolt is locked in firing position at locking projections by rotating the bolt. In order to effect this rotation the socket is connected to the bolt by guide means which initially, when the socket is axially displaced by gas pressure, rotates and disengages the bolt and then displaces the bolt axially. When the socket is returned in order to axially return the bolt this is finally rotated correspondingly by said guide to be locked again in the firing position. Since the operative connection between the piston-cylinder device operated by gas pressure in this case is provided by means of a socket mounted at the rear end of the bolt, the connection of which with the piston-cylinder device is not shown in detail in the German patent specification, an extension of the weapon at the rear end thereof is necessary in a manner not desired.

The primary object of the invention is to provide a firearm of the kind referred to above which is easy to manufacture by simple resources because the firearm comprises relatively simple constructional elements which, moreover, can be easily mounted and dismounted, the maintenance of the weapon being facilitated thereby.

Another object of the invention is to provide a firearm of the kind referred to above, which can be constructed with a heavy barrel mounted in such a way that the weapon is stable as to mechanical and thermal strains so that the accuracy of firing is not impaired by mechanical or thermal deformation of the barrel or by barrel oscillation. Despite the stable construction including a heavy barrel the weapon can be made light as compared to prior art firearms of a similar type.

A further object of the invention is to provide a firearm of the kind referred to above wherein the bolt is supported and guided by means which are less space-requiring than prior art firearms of a similar type because the bolt is guided for displacement on the barrel proper and accordingly does not require a separate support, and wherein a favourable distribution of forces is obtained at the operation of the bolt due to a symmetric force pattern.

A still further object of the invention is to provide a firearm of the kind referred to above wherein the means for locking the bolt in the firing position will not be dirty due to exposure to powder gases, because it is located on the outside of the barrel, and wherein the bolt can be more reliably locked in the firing position because the locking projections are located on the outside of the barrel, i.e. on a larger diameter than in firearms wherein the locking projections or other locking surfaces are located inside the barrel as in the prior art firearms disclosed in the patent specifications discussed above.

In order to achieve these and other objects the invention provides a firearm comprising a barrel, a bolt at one end of the barrel, means on the bolt mounting the bolt for axial displacement on the outside of the barrel to and from a firing position and for rotational movement on the barrel, spring means biasing the bolt towards the firing position, a carrier non-rotatably guided for axial displacement on the outside of the barrel, said spring means biasing said carrier to a forward position, means operatively connecting said means mounting the bolt to said carrier for axial displacement of the bolt by the carrier, and at least one locking element on the outside of the barrel for cooperation with said bolt in the firing position thereof, said connecting means guiding the bolt for rotation by axial displacement of the carrier to engage the bolt with the locking element after axial displacement to the firing position and to disengage the bolt from the locking element before axial displacement of the bolt from the firing position.

In a preferred embodiment the projecting portion of the bolt comprises two limbs extending one on each side of the barrel, and the guide means comprises helical ribs and grooves on the projecting portion of the bolt and the carrier.

It is also preferred that said axially displaceable element forms part of a piston-cylinder device and is slidably mounted on the barrel, said carrier being mounted between the displaceable element and the bolt.

In order to explain the invention an illustrative embodiment thereof will be described in more detail below with reference to the accompanying drawings in which FIG. 1 is a longitudinal cross-sectional view, partly a side view, of an automatic carbine according to the invention;

Figure 1:
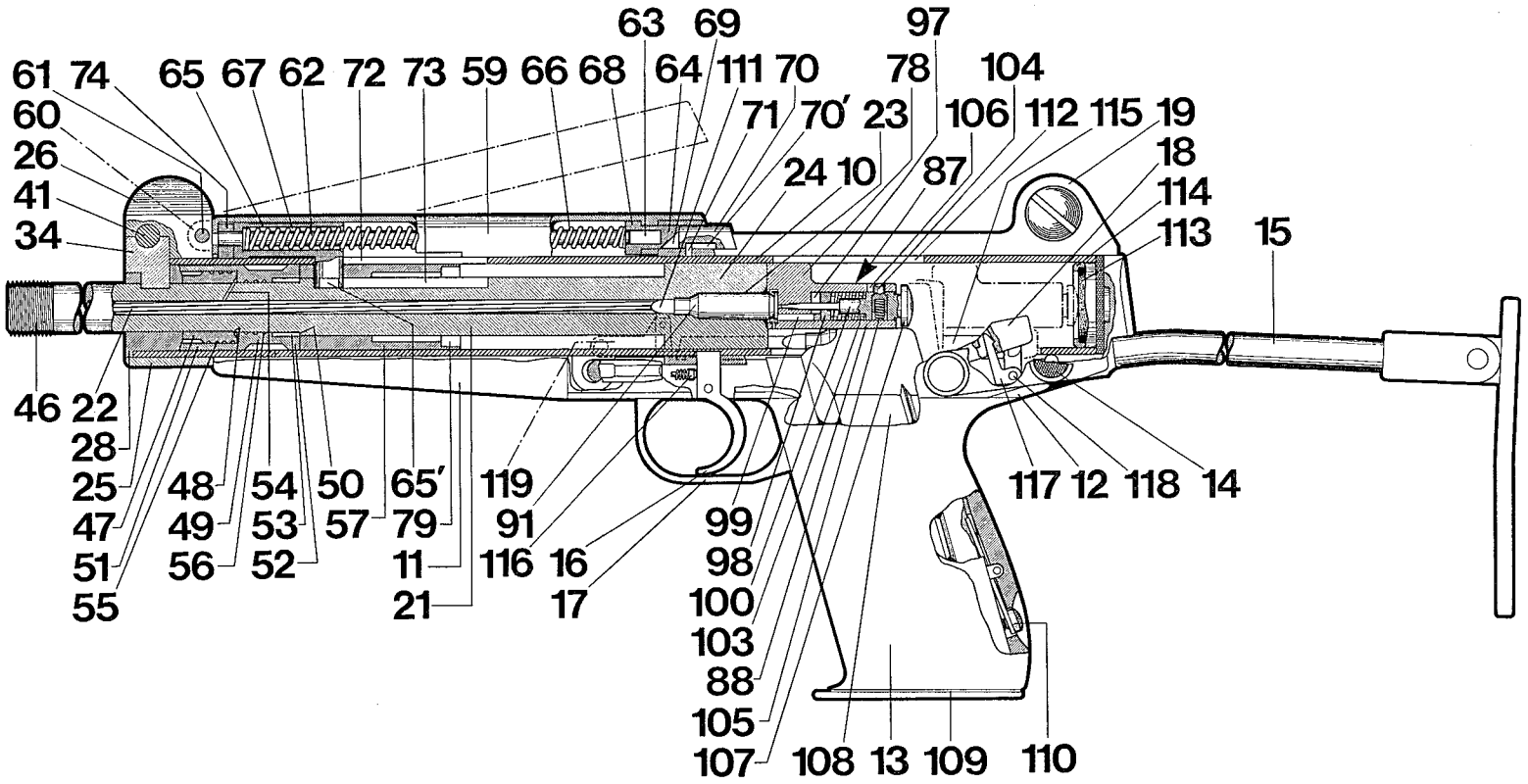

Referring to FIG. 1, the automatic carbine shown therein comprises an upper receiver 10 consisting of a cylindrical metal tube which is surrounded over a major part of the lenght thereof by a forearm or lower handguard 11 of wood or plastics and is provided at the rear end thereof with a lower receiver 12 and a pistol grip 13. The lower receiver closes the upper receiver at the rear end thereof and is provided with a transverse attachment bolt 14 for a folding stock 15. This folding stock can be replaced by a permanently fixed butt stock. On the front side of the pistol grip 13 a trigger 16 and a conventional trigger guard 17 are provided. The trigger 16 is operatively connected with a hammer 18 by a firing mechanism to be described later. A backsight 19 is provided on top of the upper receiver 10 at the rear end thereof.

A barrel 21 having a rifled bore 22 and a chamber 23 is slidably guided in the upper receiver 10 by means of a guiding and locking barrel head 24 provided at the rear end of the barrel, which is shown to be integral with the barrel; alternatively the barrel head can be fastened by screw threads to the barrel as a separate part. The barrel is detachably connected to the upper receiver at the front end thereof in a manner which allows the barrel to be dismounted from the upper receiver in a simple manner, said connection being obtained by means of the specific arrangement shown in more detail in FIGS. 4 and 5.

Figure 4:
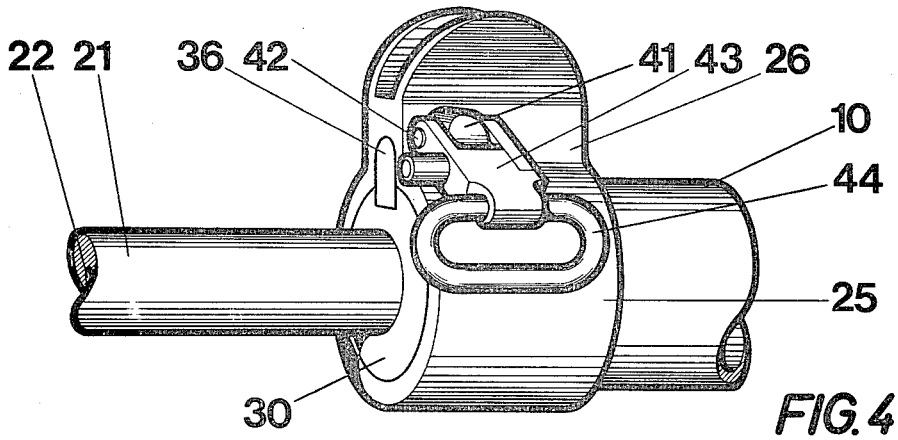
FIG. 4 is an enlarged fragmentary perspective view of the forward portion of the automatic carbine and discloses the attachment of the barrel in the upper receiver.
Figure 5:
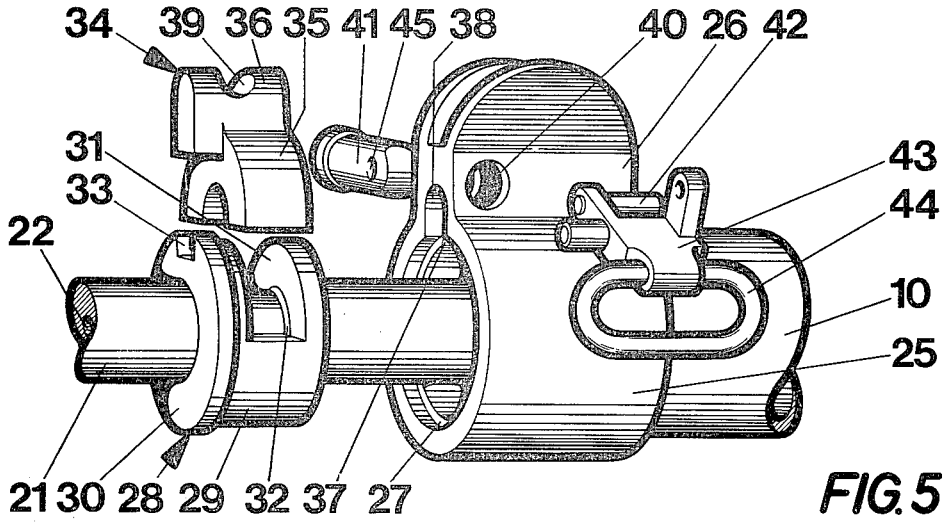
FIG. 5 is an exploded fragmentary perspective view of the arrangement in FIG. 4.

Referring to FIGS. 4 and 5 an external socket 25 is integral with a foresight guard 26 and is connected to the upper receiver at the front end thereof, e.g. by riveting. The socket 25 projects slightly from the end of the upper receiver so that the end surface of the receiver forms a shoulder 27 inside the socket as seen in FIG. 5. A barrel bushing 28 has slide fit on the barrel 21 and comprises a cylindrical body portion 29 dimensioned to have slide fit inside the upper receiver, and a cylindrical annular flange 30 at the outer end of the body portion, which fits into the projecting portion of the socket 25, that is defined by the shoulder 27. In the body portion 29 of the barrel bushing 28 a semi-circular through slot 31 is provided. A semi-circular groove 32 coextensive with said slot is provided in the barrel at the position where the barrel bushing shall be connected to the barrel such that the groove 32 forms the bottom and the lower portions of the side walls of the slot 31 when the barrel bushing is mounted at said position. A notch 33 is provided in the flange 30 and extends through the body portion 29 to the slot 31 said notch being located centrally of the slot.

A lock piece 34 comprises a semi-circular ring 35 and a radial lug 36 which is located centrally on the upper side of the semi-circular ring 35 and projects axially from one end surface thereof. When the barrel bushing 28 has been mounted on the barrel 21 in the position shown in FIG. 5, i.e. with the slot 31 registering with the groove 32, the lock piece 34 can be inserted into the slot and the groove, the portion of the lug 36 projecting from the semi-circular ring 35 being received by the notch 33. The lock piece 34 is dimensioned in such a way that when the lock piece is mounted in this manner the outside curved surface thereof is substantially flush with the outside curved surface of the body portion 29 of the barrel bushing 28, and the end surface of the lug 36 is substantially flush with the end surface of the annular flange 30. When the lock piece 34 is inserted into the barrel bushing 28 as described this is fixedly connected to the barrel 21 as far as the axial position thereof is concerned, by the engagement of the lock piece in the slot 31 as well as the groove 32. When the barrel 21 is inserted into the upper receiver 10, the body portion 29 of the barrel bushing 28 is received by the forward end of the upper receiver, while an axial slot 37 is provided in the upper receiver and a corresponding groove 38 is provided in the outer socket 25 to receive the lug 36 of the lock piece and thus fix the rotational position of the barrel. When the flange 30 abuts the shoulder 27 the end surfaces of the flange 30 and the lug 36 are flush with the annular end surface of the socket 25 as shown in FIG. 4, and in this position a semi-circular notch 39 in the lug 36 of the lock piece registers with a circular cross bore 40 in the foresight guard 26. The barrel 21 can now be finally locked in position in the upper receiver 10 by a key 41 being inserted through the bore 40 at the same time passing through the semi-circular notch 39. The key is locked by means of a cross pin 42 which is provided on a fore-end sling swivel 43 having an eyelet 44, and is inserted through a cross bore 45 in the key 41.

The connection of the barrel as described above is sturdy and easy to mount and dismount. This means that the weapon can easily be dismounted without tools because the barrel 21 and the elements mounted thereon as will be described below, can be withdrawn from the upper receiver 10 to be cleaned and checked. Moreover, the barrel can move freely longitudinally at temperature changes. In the present case the barrel has a somewhat larger thickness of material than that usually applied, because the barrel and not the upper receiver is the part of the weapon according to the invention wherein all substantial forces are received at firing. The larger thickness of material also provides a greater firing endurance.

The forward end of the barrel is threaded at 46 for the attachment of a flash-suppressor or flash-hider not shown herein.

For repetitive firing (automatic firing) the automatic carbine is provided with a piston-cylinder device operated by powder gas. Referring again to FIG. 1 said device comprises a stationary piston 47 passed onto the barrel 21 from the forward end thereof. The forward end portion of the barrel has reduced diameter and joins the adjacent portion of the barrel at a small shoulder 48. The stationary piston 47 is fixedly mounted between the shoulder 48 and the barrel bushing 28. A cylinder 49 co-operating with the piston is guided for axial displacement on the outside of the barrel 21 between the inner end of the piston, located at the shoulder 48, and a further shoulder 50 on the barrel, and is guided also on the outside of the piston by means of a sleeve portion 51 of the cylinder. The stroke of the cylinder is determined by the left end position of the cylinder, in which the sleeve portion 51 engages the barrel bushing 28 or, alternatively, the cylinder engages the right end of the piston 47, and the right end position of the cylinder, in which the cylinder engages the shoulder 50. The cylinder also has at the right end thereof a sleeve portion 52 of such a length that it terminates at the shoulder 50, when the cylinder is in the left end position thereof, and of such an inner diameter that said sleeve portion 52 can slide over the wider portion of the barrel located inwardly (to the right) of the shoulder 50. In other words, the stroke of the cylinder forming the displaceable element of the piston-cylinder device equals the axial length of the recess 53 formed inside the sleeve portion 52.

A gas port 54 communicating with the bore 22 is provided in the barrel 21 said gas port opening into the cylinder space inside the sleeve portion 51 at the right end surface of the piston 47 as seen in FIG. 1 in order to admit powder gas into the cylinder 49 and thus displace the cylinder to the right in relation to the piston 47 and the barrel 21 in a manner to be described in more detail below.

The piston 47 and the cylinder 49 are formed with turbulence seals 55 and 56, respectively, to seal against the sleeve portion 51 and the barrel 21, respectively. The cylinder is not, however, sealed or guided at the inner surface of the upper receiver 10. The turbulence seal 55 of the piston 47 is helical in order to provide a slow evacuation of powder gases from the cylinder 49.

Figure 2:
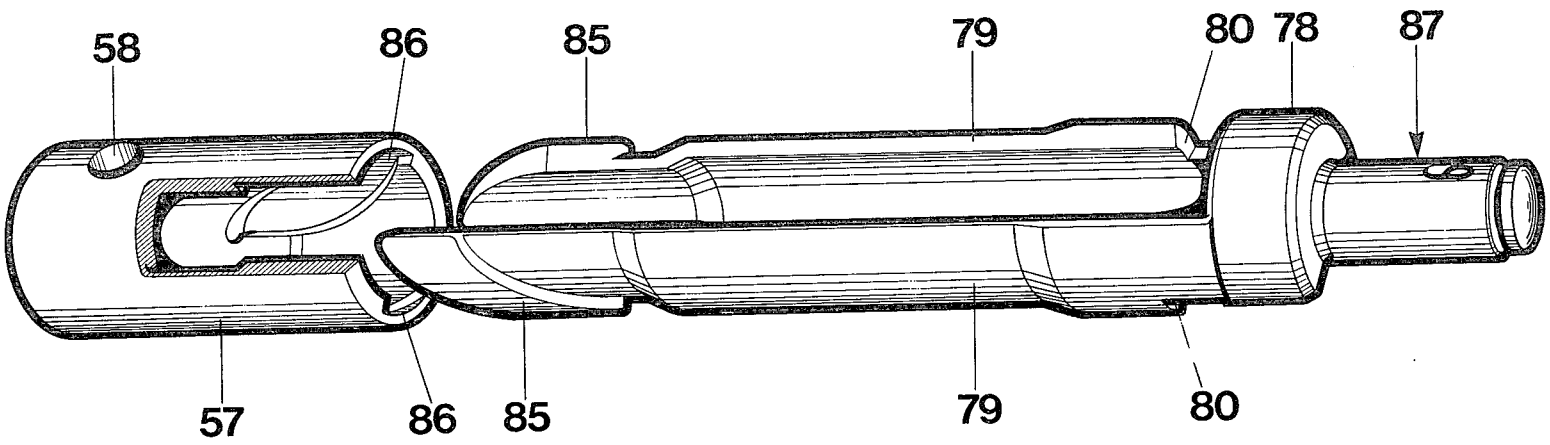
FIG. 2 is a perspective view of the bolt and the carrier for operating the bolt, removed from the weapon and spaced from each other.

A cylindrical carrier 57 also shown in FIG. 2, is guided for displacement on the barrel 21 inwardly of the shoulder 50 but this carrier is guided at the inner surface of the upper receiver 10. A radially through cylindrical bore 58 is provided in the wall of the carrier for the connection of the carrier to an operating mechanism on top of the automatic carbine.

As shown in FIG. 1 the operating mechanism comprises an elongated spring housing 59 which is pivoted to the foresight guard 26 by means of a fork 60 and a pin 61 so that the spring housing can be swung upwards about a cross axis from the position shown by solid lines, in which the bottom of the spring housing engages the upper side of the upper receiver. The pivoted arrangement is indicated in FIG. 1 by the spring housing swung partly upwards being shown in dot lines and dash lines. A cylindrical bar 62 is connected to the end of the spring housing which is pivoted to the foresight guard, and extends through the spring housing in the longitudinal direction thereof towards the rear end where the bar is partly inserted into a blind hole 63 in a latch pin 64. This pin is non-rotatably guided for axial displacement in the spring housing and is guided for axial displacement also on the bar 62 which does not extend to the bottom of the blind hole 63. A slide 65 is guided for displacement on the bar 62 and in the spring housing 59, and a helical pressure spring 66 arranged on the bar is engaged between said slide and the pin 64, said spring being partly received in a bore 67 in the slide 65. Thus, the spring 66 biases the slide 65 to the position shown at the left end of the spring housing 59 and the latch pin 64 to the position shown in which the latch pin engages the right end of the spring housing 59 at a flange 68. The pin 64 partly projects from the spring housing to engage a bore 69.

In this manner the spring housing 59 is arrested in the position shown. However, it can be disengaged by the latch pin 64 being depressed from the bore 69 against the bias of the spring 66. For this purpose there is provided in the bore 69 an axially displaceable push button 70 the stroke of which is limited by a fixed pin 71 which projects into an axial groove 70' in the bottom of the push button 70. The projecting end of the latch pin 64 is bevelled to enable said pin to snap into the bore 69 when the spring housing is being swung to the position shown.

The slide 65 forms a cylindrical pin 65' projecting radially therefrom, which extends through the open bottom of the spring housing 59 and through a longitudinal slot 72 in the upper receiver 10 into and through the bore 58 in the carrier 57 to be received at the free end thereof, which is bevelled at the sides, in a groove 73 extending in the upper side of the barrel 21 in parallel with the slot 72 and having the same extent as the slot. In this manner the carrier is non-rotatably guided for axial displacement on the barrel. Under the bias of the spring 66 the carrier is held in the position shown in FIG. 1, but it can be displaced to the right against the spring bias by means of the cylinder 48 when said cylinder is displaced to the right by gas pressure generated at firing, as will be described below.

Figure 6:
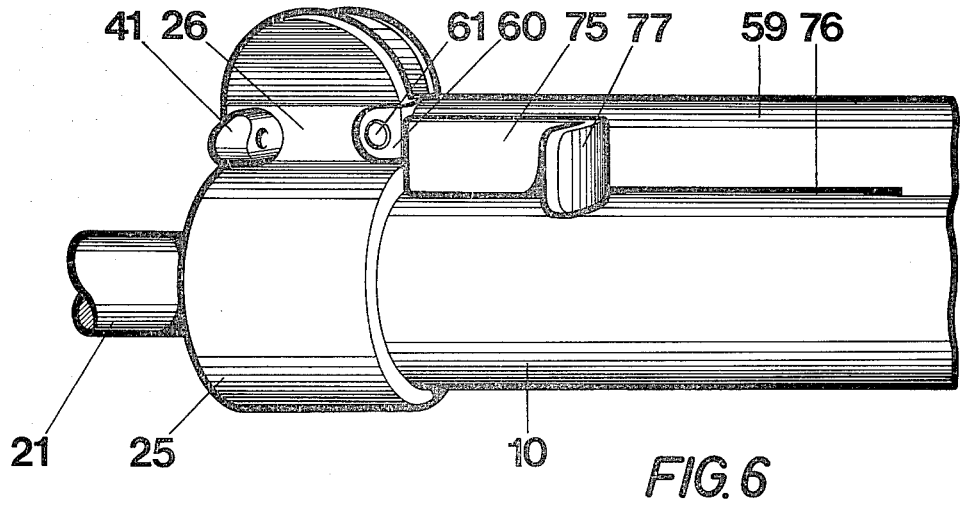
FIG. 6 is an enlarged fragmentary perspective view of the forward portion of the automatic carbine, showing means for manually operating the bolt.

It is desired that the carrier 57 can be displaced to the right also manually against the bias of the spring 66, and therefore a sleeve 74 is slidably mounted on the bar 62 of the operating mechanism. Said sleeve forms a separate element in relation to the slide 65 and is connected to an operating arm 75, FIG. 6, which projects laterally from the spring housing 59 through a longutidinal notch or slot 76 in the spring housing at the lower edge thereof and then extends along the spring housing externally thereof to form a finger-grip 77 at the end. A corresponding operating arm with a finger-grip is provided on the opposite side of the operating mechanism.

The bolt of the automatic carbine is designated 78. It can be reciprocated to eject an empty cartridge case when the weapon has been fired, and to insert a new cartridge into the chamber 23, and this movement of the bolt can be accomplished either by means of the cylinder 49 of the gas-operated piston-cylinder device or manually by manipulating the fingergrip 77, in both cases through the intermediary of the carrier 57.

Figure 3:
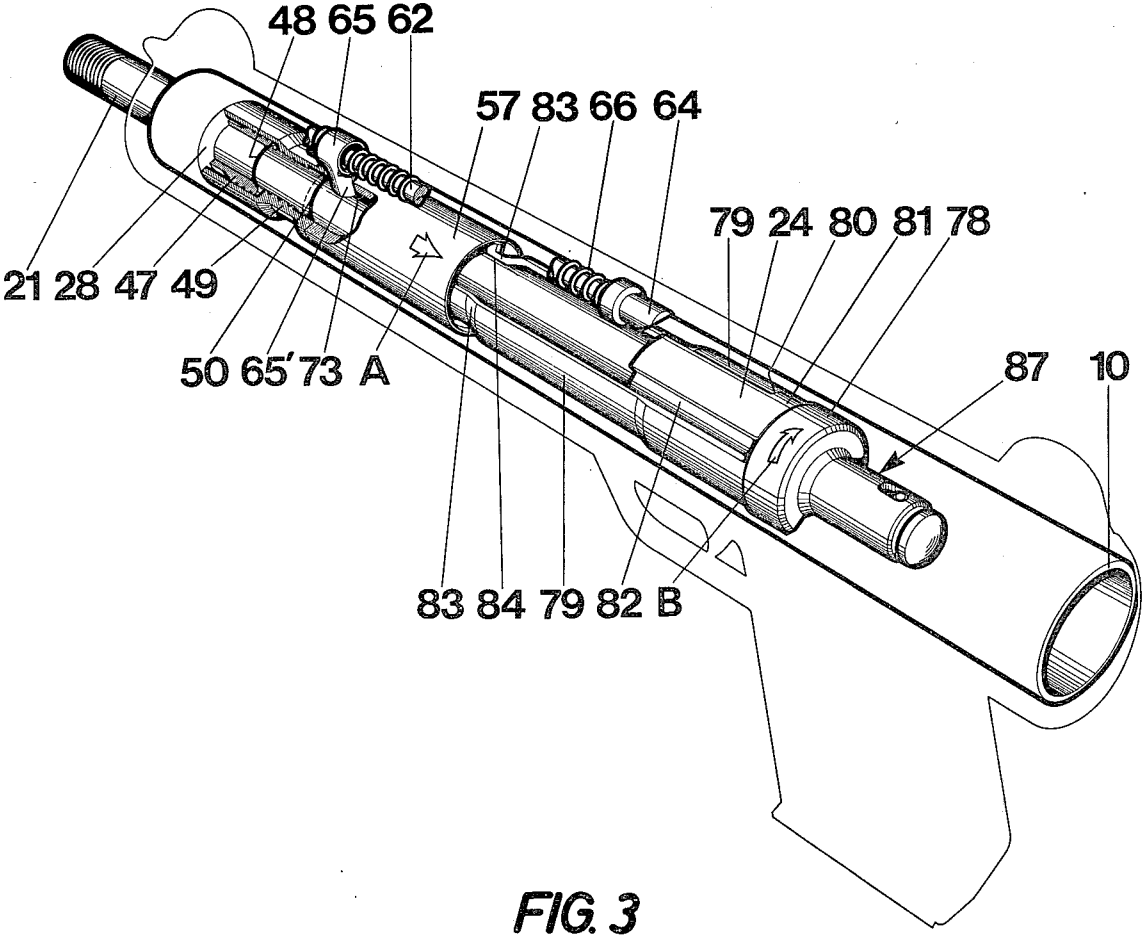
FIG. 3 is a diagrammatic perspective view of the automatic carbine as seen from the rear end thereof showing the barrel with the elements mounted thereon, i.e. bolt, piston-cylinder device and carrier.

Referring to FIG. 1 as well as FIGS. 2 and 3, the bolt 78 forms two cylindrically curved limbs 79 extending along the barrel 21 one at each side thereof. Each limb forms a shoulder 80 near the bolt 78 due to a reduction of the width of the limb, and the guide head 24 forms a locking projection 81 to co-operate with each of these shoulders as shown in FIG. 3. The guide head also forms a groove 82 for each limb, which is sufficiently wide to allow the part of the limb 79 having the maximum width to pass through this groove. When the bolt 78 is in the position shown in FIG. 3 wherein each shoulder 80 engages in front of the associated locking projection 81, the bolt is locked against rearward movement. However, by the bolt being rotated, which is allowed by the groove 82, the shoulder 80 will clear the locking projection 81 such that the bolt will be free for rearward movement in the rear portion of the upper receiver 10; see FIG. 9. The bolt is guided for reciprocating movement thereof by means of the limbs 79. These limbs engage the guide head 24 in the grooves 82, and at an angled shoulder 83 the limbs change to a shorter spacing to engage also the barrel at 84. The radius of curvature of the limbs is of course matched to the radius of curvature of the respective portions engaged by the limbs.

Figure 9:
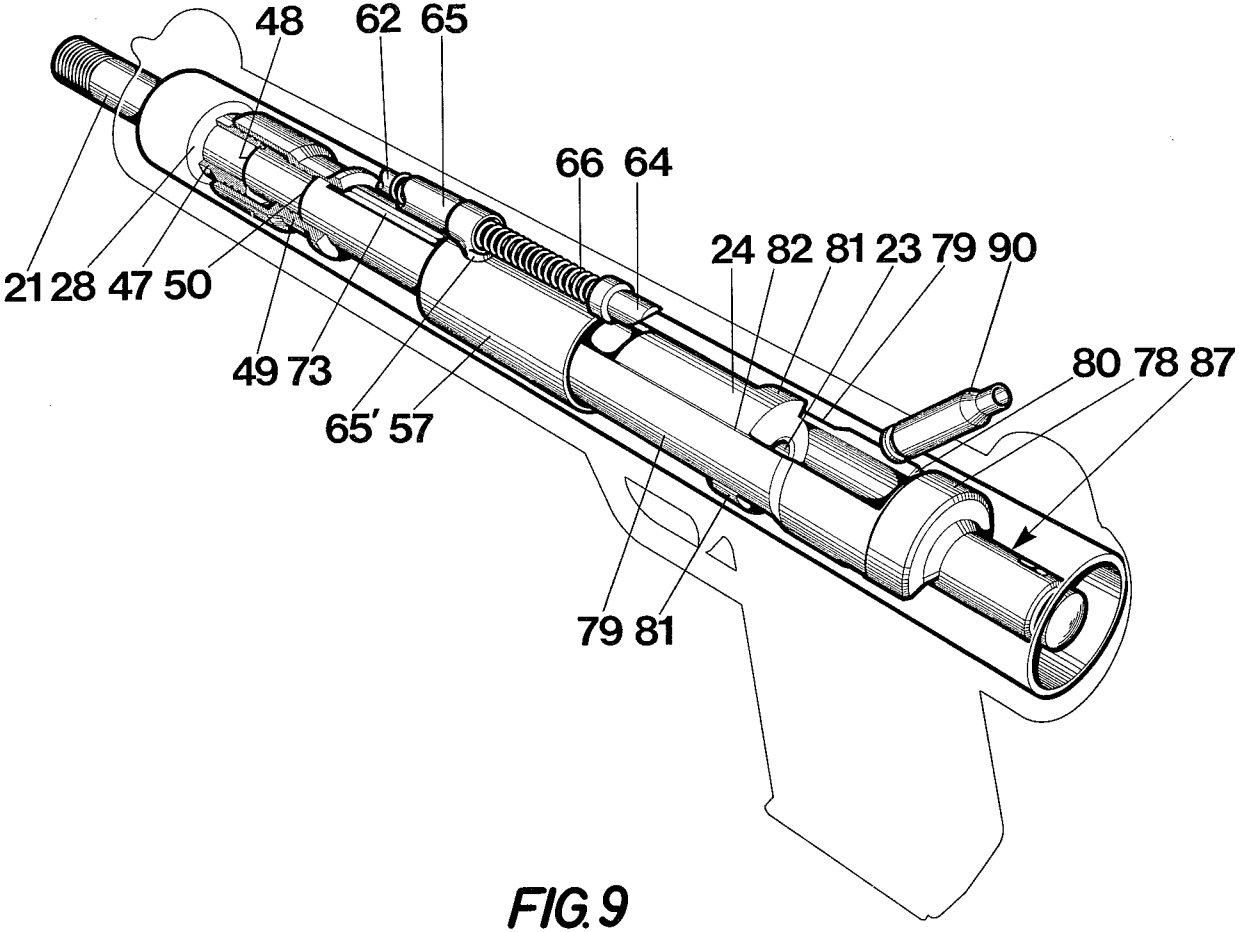
FIG. 9 is a view corresponding to FIG. 3 showing the elements mounted on the barrel in the position attained after displacement of the cylinder to the position according to FIG. 8.

In order to move the bolt 78 backwards from the position shown in FIG. 3 to the position shown in FIG. 9 it is accordingly necessary to rotate the bolt initially to disengage the bolt from the locking projections 81, and such rotational movement is effected by means of the carrier 57 during the axial displacement thereof on the barrel 21 to the right as seen in FIG. 1, i.e. rearwardly against the bias of the spring 66. For this purpose there are provided on the outer side of the limbs 79 at the free ends thereof two helical ribs 85, FIG. 2, each of which is received in a corresponding helical groove 86 inside the carrier 57. Grooves and ribs have such a pitch and such a length that the displacement of the carrier 57 towards the rear end of the weapon, arrow A in FIG. 3, when the bolt 78 is locked against axial displacement at the locking projections 81, effects an initial rotational movement, arrow B in FIG. 3, of the bolt 78 over an angle which is sufficiently large to disengage the bolt from the locking projections 81 at the shoulders 80 of the limbs 79. Thus, the bolt will be free for axial movement when the carrier is being displaced axially in relation to the limbs. Then, the bolt is carried along by the carrier during the axial movement thereof when the carrier is further displaced towards the rear end of the weapon. As will be realized, the bolt and the carrier will initially move together axially by movement of the carrier in the opposite direction, i.e. towards the front end of the weapon, and then the carrier will move axially in relation to the limbs of the bolt head when the bolt head is in the forward end position against the rear end of the barrel to effect again by the screw engagement with the limbs, rotation of the bolt in the direction opposite to that indicated by the arrow B in order that the bolt shall again lockingly engage the locking projections 81 at the shoulders 80 and thus be retained in the firing position.

When the carrier 57 is maintained in the locked position shown in FIG. 1 by the spring 66 a minor gap exists between the left end of the carrier and the right end of the cylinder 49, the carrier being locked against axial movement under the bias of the spring 66 not by engagement with the cylinder 49 but by the engagement at the locking projections 81, transferred to the carrier by the limbs 79 and the interengaging ribs 85 and grooves 86.

Figure 10:
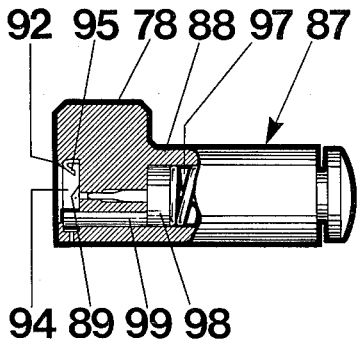
FIG. 10 is a side view, partly an axial cross-sectional view of the bolt proper without the limbs.
Figure 11:
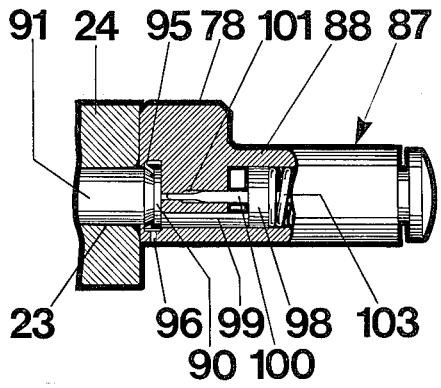
FIG. 11 is a view similar to FIG. 10 with the bolt in firing position, engaging the rear end of the barrel, fragmentarily shown in axial cross-sectional view.
Figure 12:
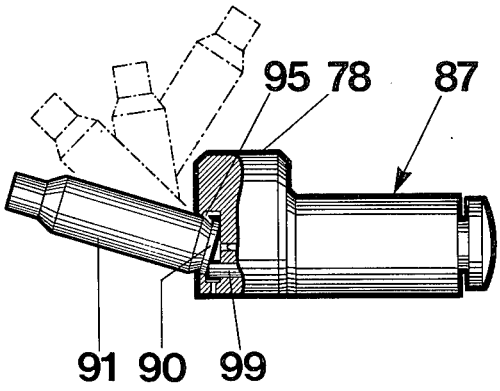
FIG. 12 is a view similar to FIG. 10 with the bolt in a retracted position for ejecting the empty cartridge case.

The bolt 78 is provided with a striker and ejector mechanism 87 which is shown in FIG. 1 and in more detail in FIGS. 10 to 12.

The striker and ejector mechanism comprises a firing unit housing 88 which is integral with the bolt 78 and projects at the rear end thereof while the bolt at the front end thereof, i.e. in the bolt face which shall be engaged with the guide head 24 in the firing position, has a circular seat 89 for receiving the flange 90 of the case 91 of a cartridge inserted into the chamber 23, FIG. 11. The seat 89 is formed with an inwardly directed annular rim 92 which defines an opening sufficiently large to allow the flange 90 to pass therethrough when it is being inserted into the seat. A slotted annular blade spring 94 is arranged inwardly of the rim 92, said spring having at the top thereof a hooked extractor 95 to engage in front of the flange 90. A radial pin 96 is provided on the annular spring 94 to maintain the spring in the correct position, said pin being received in the firing unit housing 88.

An ejector 98 is guided for axial displacement in a bore 97 in the firing unit housing 88, and said ejector has an ejector arm 99 which extends through the bolt face into the seat 89 at the bottom thereof, i.e. in a position diametrically opposite to the extractor 95. A firing pin 100 is also guided for axial displacement in the bore 97 and the tip thereof penetrates through a central bore in the ejector 98 and continuous into a bore 101 in the bolt head, said latter bore opening centrally in the bottom of the seat 89. A helical pressure spring 103 is engaged between the ejector 98 and the firing pin 100 and is received in the bore 97 to bias the ejector to ejecting position and to hold back the firing pin. The firing pin is retained in the housing against the spring bias by a cross pin 104 in the firing pin, said cross pin being biased by a helical pressure spring 105 and held against an abutment by said spring the end of the pin projecting into a longitudinal slot 106 in the housing 88. The cross pin 104 can be depressed from the slot 106 by means of a suitable tool against the bias of the spring 105 such that the firing pin 100 and thus the remaining elements mounted in the firing unit housing 88 can be withdrawn from the bore 97 at the rear end of the housing. An impact head 107 is formed on the firing pin 100 outside the housing at the rear end thereof to co-operate with the hammer 18.

The pistol grip 13 forms a guide for an ordinary type cartridge magazine 108 which is slid into the pistol grip from the open lower end 109 thereof in a conventional manner and is held in operative position in the pistol grip by means of a magazine catch 110 which can be manually operated in order to release the magazine for withdrawal from the pistol grip.

The cartridges comprising the case 91 and a projectile 111 are fed through the magazine by a magazine follower spring in a conventional manner to be inserted into the chamber 23 by the bolt 78 at the forward movement thereof. When the cartridge is in the chamber 23 and the bolt 78 is in the firing position the flange 90 of the cartridge case is received in the seat 89, the extractor 95 engaging the flange as shown in FIG. 11 and the ejector 98 being held back by the flange against the bias of the spring 103. After firing the empty cartridge case must be thrown out and this is done at the rearward movement of the bolt 78 by means of the ejector 98 pressing against the cartridge flange 90 at the lower end thereof under the bias of the spring 103 such that a pivoting movement upwards is imparted to the cartridge case due to the engagement of the extractor 95, as indicated by dot and dash lines in FIG. 12. An opening 112 is provided in the upper receiver 10 for the ejection of the empty cartridge cases.

A buffer 113 of synthetic rubber is provided at the rear end of the upper receiver for the bolt, said buffer being fitted into a socket 114 attached to the lower receiver.

The firing mechanism which should be able to operate with full automatic fire as well as semiautomatic fire can be of a conventional structure having a disconnector for sensing that the bolt of the weapon is in locked position before the weapon can be fired. With reference again to FIG. 1, the firing mechanism comprises a trigger bar 115 which is guided for longitudinal displacement. The trigger 16 is operatively connected to said trigger bar for displacement of the trigger bar forwards when the trigger is manually actuated to pivot the trigger in counter-clockwise direction as seen in FIG. 1 against the bias of trigger spring means 116. The trigger bar 115 is operatively connected at the rear end thereof to a sear 117 cooperating with the hammer 18 said sear ring being pivotally mounted by a sear pin 118. In the position shown the the sear 117 engages the hammer 18 to hold the hammer at full cock against the hammer spring bias. When the trigger 16 is operated to displace the trigger bar 115 forwards the sear is disengaged from the hammer 18 which rotates counter-clockwise to hit the impact head 107 the firing pin 100 being displaced towards the primer of the cartridge against the bias of the spring 103 to fire the cartridge.

As mentioned above the bolt 78 must be in the locked position before the trigger 16 can reach the trigger bar for firing the weapon and for this purpose a rocker arm mechanism 119 is provided which is depressed against spring bias by one of the limbs 79 when the bolt 78 is disengaged from the locking projections 81, to be held in a position wherein the operative connection between the trigger 16 and the trigger bar 115 is interrupted.

Figure 7:
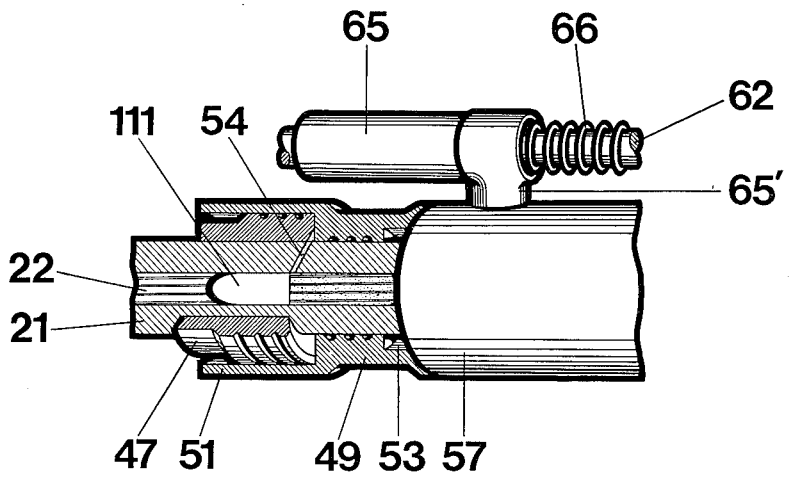
FIG. 7 is a fragmentary perspective view, partly an axial cross-sectional view, of the piston-cylinder device in operative position at the initial supply of powder gas to the cylinder from the bore of the barrel after firing.
Figure 8:
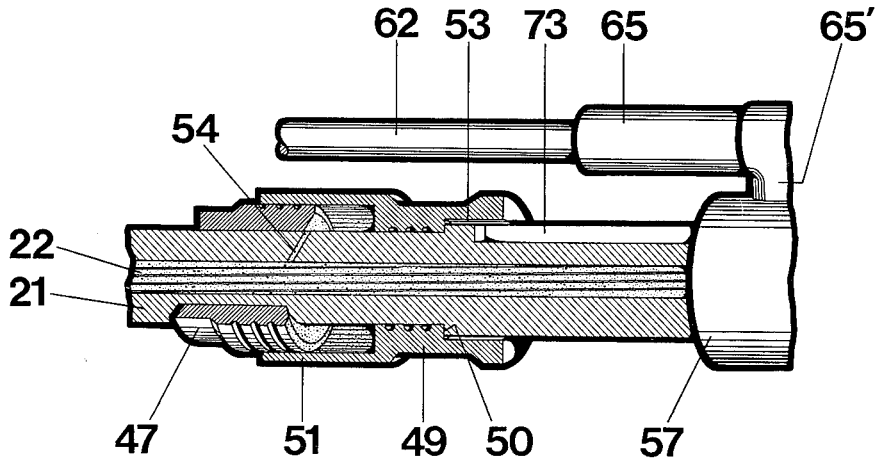
FIG. 8 is a view corresponding to FIG. 7 after displacement of the cylinder to the rear end position thereof by gas supplied to the cylinder.

When the weapon has been fired from the automatic carbine described, the interior space of the cylinder 49 will be pressurized via the gas port 54 by the powder gas generated in the bore 22 as shown in FIG. 7, as soon as the projectile 111 has passed the gas port 54. The cylinder 49 is displaced under the influence of the gas pressure to the right as seen in FIG. 7 and displaces the carrier 57 against the bias of the spring 66. By the engagement between the carrier and the limbs 79 of the bolt 78 at the ribs 85 and the grooves 86 the bolt is initially rotated as described above so that the bolt which is locked during the firing at the locking projections 81 and the shoulders 80, disengages said projections. The movement of the cylinder will be stopped at the shoulder 50 as shown in FIG. 8, but the carrier 57 and the bolt 78 will continue to move to the right by inertia and by influence of the remaining gas pressure acting against the bolt face of the bolt to attain the right end position according to FIG. 9, the empty cartridge case 91 being ejected during this movement, as has also been described above. When the gas pressure is again relieved through the opening of the barrel 21, when the projectile 111 has left the bore 22, the carrier 57 will be returned by the spring 66, at the same time returning the cylinder 49 and pulling the bolt 78 against the rear end of the barrel 21 for a new firing. During the return movement the bolt 78 carries a new cartridge from the magazine into the chamber 23, and the bolt is again locked in the position shown at the shoulders 80 and the locking projections 81 during the final part of the return movement of the carrier 57 by the rotation of the bolt accomplished thereby. Then, the elements are again in the positions according to FIGS. 1 and 3.

As mentioned above, there is obtained by the arrangement according to the invention the essential advantage that the barrel when heated can expand freely longitudinally without strains arising in the connection at the front portion of the barrel. No uneven load on the barrel will occur as in a case of conventional systems wherein the barrel is exposed to bending strains due to the fact that the piston cylinder device is arranged excentrically in relation to the barrel. Since the weapon is built up around the barrel in the manner described, a very simple mounting of the entire weapon is provided, and the parts from which the weapon is constructed can be easily manufactured by using simple resources. The weapon can be applied against a support without the risk of varying oscillation of the barrel, because the weapon is supported at the upper receiver. Barrel oscillation is reduced because the barrel is guided at both ends of the tubular upper receiver which is substantially rigid. Despite the heavy barrel, the weight of the weapon is kept low because no substantial forces act on the remaining parts such as the upper receiver etc., whereby these parts can be manufactured with a smaller thickness of the material.

It is easy to remove the "system", i.e. the barrel and the parts mounted thereon, from the weapon according to the invention of the weapon fails during firing. It is also easy to clean the weapon.

Another advantage obtained by the invention is that said "system" easily can be replaced by a system of the same type or by a system dimensioned for cartridges of a different kind.

An automatic carbine has been described as an illustrative embodiment but the term used is not limiting; larger or smaller automatic firearms can be constructed according to the invention, and the invention can also be applied to minor automatic guns. The external form of the weapon is of no significance as far as the application of the invention is concerned, and as mentioned above, different types of firing mechanisms can be combined with the arrangement according to the invention.

The invention can be used in weapons without a gas port and a piston-cylinder device connected thereto, the movement of the bolt always being accomplished by manual operation at the finger-grip 77, and in weapons which are not automatic firearms in the common sense, i.e. weapons by which one shot is fired at a time but the supply of a new cartridge to the chamber takes place automatically after each shot by means of the gas-operated piston-cylinder device (semiautomatic weapons). The piston-cylinder device can be constructed in another way than that shown. E.g. the cylinder can constitute the stationary part of this device while the piston is the movable part and can be formed by the front portion of the carrier, said portion being received in the cylinder.

We claim:

1. A firearm comprising a barrel, a bolt at one end of the barrel, means on the bolt mounting the bolt for axial displacement on the outside of the barrel to and from a firing position and for rotational movement on the barrel, spring means biasing the bolt towards the firing position, a carrier non-rotatably guided for axial displacement on the outside of the barrel, said spring means biasing said carrier to a forward position, means operatively connecting said means mounting the bolt to said carrier for axial displacement of the bolt by the carrier, and at least one locking element on the outside of the barrel for cooperation with said bolt in the firing position thereof, said connecting means guiding the bolt for rotation by axial displacement of the carrier to engage the bolt with the locking element after axial displacement to the firing position and to disengage the bolt from the locking element before axial displacement of the bolt from the firing position.

2. A firearm as claimed in claim 1 wherein said means mounting the bolt on the outside of the barrel comprises two limbs projecting from the bolt one on each side of the barrel.

3. A firearm as claimed in claim 2 wherein said connecting means comprises interengaging helical ribs and grooves on the projecting limbs of the bolt and the carrier.

4. A firearm as claimed in claim 1 comprising a piston-cylinder device communicating with the bore of the barrel for displacing the carrier by means of the gas pressure generated at firing.

5. A firearm as claimed in claim 4 wherein the displaceable element of the piston-cylinder device is displaceably guided on the outside of the barrel.

6. A firearm as claimed in claim 5 wherein the carrier is mounted between the displaceable element of the piston-cylinder device and the bolt.

7. A firearm as claimed in claim 4 wherein the piston-cylinder device comprises a stationary piston mounted on the outside of the barrel, and a cylinder axially displaceable in relation to the piston and the barrel, said cylinder forming the displaceable element.

8. A firearm as claimed in claim 4 wherein the displaceable element of the piston-cylinder device is mounted on the outside of the barrel between abutments thereon and is adapted to engage the carrier for axial displacement thereof.

9. A firearm as claimed in claim 1 wherein said spring means is releasably connected to the carrier.

10. A firearm as claimed in claim 1 further comprising an upper receiver, said barrel being slidingly guided in the upper receiver at the rear end thereof and being releasably connected with the upper receiver at the forward end thereof.

* * * * *